US006485360B1

(12) United States Patent
Hutchins

(10) Patent No.: US 6,485,360 B1
(45) Date of Patent: Nov. 26, 2002

(54) ORBITAL SANDING TOOL

(75) Inventor: Donald H. Hutchins, Sierra Madre, CA (US)

(73) Assignee: Hutchins Mfg, Co., Pasadena, CA (US)

( * ) Notice: Subject to any disclaimer, the term of this patent is extended or adjusted under 35 U.S.C. 154(b) by 42 days.

(21) Appl. No.: 09/619,927

(22) Filed: Jul. 20, 2000

Related U.S. Application Data

(60) Provisional application No. 60/144,746, filed on Jul. 20, 1999.

(51) Int. Cl.[7] ..... B24B 27/08

(52) U.S. Cl. ..... 451/357; 451/354; 451/344; 451/350

(58) Field of Search ..... 451/340, 344, 451/350, 353, 354, 357; 15/49.1, 98; 30/166.3, 347, 388, 478

(56) References Cited

U.S. PATENT DOCUMENTS

| | | | | | |
|---|---|---|---|---|---|
| 1,143,725 | A | * | 6/1915 | Reed | 451/517 |
| 3,283,352 | A | * | 11/1966 | Hu | 451/357 |
| 4,058,936 | A | * | 11/1977 | Marton | 451/539 |
| 4,592,170 | A | * | 6/1986 | Hutchins et al. | 451/357 |
| 4,622,783 | A | * | 11/1986 | Konig et al. | 451/508 |
| 4,660,329 | A | * | 4/1987 | Hutchins | 451/357 |
| 4,671,019 | A | * | 6/1987 | Hutchins | 451/357 |
| 4,839,995 | A | * | 6/1989 | Hutchins | 451/375 |
| 4,986,036 | A | * | 1/1991 | Hutchins | 451/344 |
| 5,445,558 | A | * | 8/1995 | Hutchins | 451/344 |
| 5,518,441 | A | | 5/1996 | Valentini | |
| 5,597,348 | A | | 1/1997 | Hutchins | 451/450 |

OTHER PUBLICATIONS

Hutchins Manufacturing Company Advertisement for "The World's Finest Random Orbit Sander Now Becomes . . . The World's Most Versatile Random Orbit Sander . . . ", 1987 (4 pages).

Hutchins Manufacturing Company Advertisement for Model 4500, Hutchins New "Super Sander"; undated (2 pages).

* cited by examiner

*Primary Examiner*—Timothy V. Eley
*Assistant Examiner*—Alvin J. Grant
(74) *Attorney, Agent, or Firm*—Christie, Parker & Hale, LLP

(57) ABSTRACT

The orbital sander of the present invention eliminates many of the disadvantages of the prior art sanders by providing a compact, lightweight, and economical sander having a body and shroud formed from an injection-molded synthetic polymeric material. The head is replaced using a built-in plunger which engages notches in the spindle, without the need for tools. The built-in plunger enables the flexible shroud of the prior art to be replaced with a rigid polymeric shroud positioned with a minimal gap between the shroud and the head or shoe. The polymeric shroud is attached to the rest of the polymeric body structure by three screws and two pins. The pins project upwardly from the polymeric shroud and into precise engagement with the polymeric body structure, thus reducing the required drilling and tapping, providing rotational stability, and increasing the strength of the connection between the two parts. The air control valve is securely held in the housing using a set screw having a dog which engages a groove in the air control valve to resist the axial force tending to eject the air control valve from the body structure. Finally, a new muffler is used which creates a circuitous path for the exiting air, and thus dampens its acoustic energy.

4 Claims, 6 Drawing Sheets

ORBITAL SANDING TOOL

CROSS-REFERENCE TO RELATED APPLICATION(S)

This application is based on provisional patent application serial No. 60/144,746. filed Jul. 20, 1999.

BACKGROUND OF THE INVENTION

1. Field of the Invention

Orbital abrading or polishing tools have been available for many years. Examples of such tools are presented in U.S. Pat. No. 4,592,170 to Hutchins, U.S. Pat. No. 4,660,329 to Hutchins, U.S. Pat. No. 4,671,019 to Hutchins, U.S. Pat. No. 4,839,995 to Hutchins, U.S. Pat. No. 4,986,036 to Hutchins, U.S. Pat. No. 5,445,558 to Hutchins, and U.S. Pat. No. 5,597,348 to Hutchins, all of which are incorporated by reference in their entirety into the present disclosure.

2. Description of the Related Art

Orbital sanders of the prior art have, in some instances, been shaped to be held by a user in manipulating the sander and moving it along a horizontal work surface to sand that surface. Such sanders often utilize a head which carries a sheet of sandpaper and is driven rotationally by a compressed air powered motor. The motor is usually contained within a rather heavy body structure.

Typically, the head is mounted to a spindle which in turn is mounted eccentrically relative to the vertical axis of the motor so that the head orbits about the vertical axis. It is often desirable to be able quickly and easily remove the head from the drive portion of the sander in order to enable selective use of any of several heads of different sizes and shapes with a single drive unit. A drive unit and a set of different heads can then serve, in effect, as a number of different tools. In the prior art, replacing the head has been relatively difficult because tools have typically been required for unscrewing the head from the drive portion of a sander.

Previously developed portable orbital sanders have utilized a flexible shroud to provide access for insertion of a tool between the head, which is also commonly referred to as a shoe, and the housing to lock the spindle so that the head can be unscrewed manually from it. Located within the shroud and just above the spindle is a rotating counterweight used to counterbalance the eccentrically mounted spindle and head. This arrangement has several disadvantages, however. First, the flexible shroud can be pressed inwardly by an operator's fingers until it contacts the rotating counterweight. This causes wear to the sander in addition to unwanted vibrations. Also, debris can enter the space between -the shroud and the head, and thus clog the inner workings of the sander, if the flexible shroud becomes distorted. Further, there is a risk that the fingers of the operator might enter the space, causing injury to the user.

Prior art sanders have used air control valves having rotatable cylindrical valve elements for regulating the supply of compressed air to the motor. However, in order to prevent the air pressure from ejecting the air control valve axially from the body structure, the air control valve has been secured in place within the body structure using such imprecise and makeshift methods as using a strap to hold the air control valve against the body structure.

After powering the motor, the compressed air must, of course, leave the sander. The escaping high pressure air creates a loud noise which can be harmful to the operator as well as those in the area. The noise level can be lowered by packing the output path with cotton or other materials, but this leads to the disadvantage of significantly greater backpressure.

Prior orbital sanders have sometimes utilized a top cover secured to the body structure by screws passing downwardly through the cover and into threaded bores formed in the body structure. This method of securing the cover is disadvantageous and expensive, however, because it requires time-consuming drilling and threading of the body structure.

SUMMARY OF THE INVENTION

The orbital sander of the present invention eliminates many of the disadvantages of the prior art sanders by providing a compact, lightweight, and economical sander having a body and shroud formed from an injection-molded synthetic polymeric material. The head is replaced using a built-in plunger which engages notches in the spindle, without the need for tools. The built-in plunger enables the flexible shroud of the prior art to be replaced with a rigid polymeric shroud positioned with a minimal gap between the shroud and the head or shoe. The polymeric shroud is attached to the rest of the polymeric body structure by three screws and two pins. The pins project upwardly from the polymeric shroud and into precise engagement with the polymeric body structure, thus reducing the required drilling and tapping, providing rotational stability, and increasing the strength of the connection between the two parts. The air control valve is securely held in the housing using a set screw having a dog which engages a groove in the air control valve to resist the axial force tending to eject the air control valve from the body structure. Finally, a new muffler is used which creates a circuitous path for the exiting air, and thus dampens its acoustic energy.

To realize the advantages outlined above, one embodiment of the portable orbital abrading or polishing tool of the present invention includes: a tool body to be held and manipulated by a user; a motor carded by the body; an orbital drive structure driven rotatably about a first axis by the motor; a spindle having at least one notch along its outer circumference and which is connected to the orbital drive structure for rotation relative thereto about a second axis offset from the first axis to drive the spindle in an orbital path about the first axis as the orbital drive structure turns; a head threadedly connected to the spindle and adapted to carry an element for abrading or polishing a work surface; and a plunger passing through the body and movable radially inwardly, the plunger movable between a first position and a second position, wherein in the first position the plunger does not contact the outer circumference of the spindle and in the second position the plunger engages the at least one notch for any position of the spindle along the orbital path.

BRIEF DESCRIPTION OF THE DRAWINGS

In the drawings, which constitute part of this specification, embodiments demonstrating various features of the invention are set forth as follows.

DETAILED DESCRIPTION OF THE PREFERRED EMBODIMENTS

Although detailed illustrative embodiments are disclosed herein, other suitable structures and machines for practicing the invention may be employed and will be apparent to persons of ordinary skill in the art. Consequently, specific structural and functional details disclosed herein are representative only; they merely describe exemplary embodiments of the invention.

Figure 1:
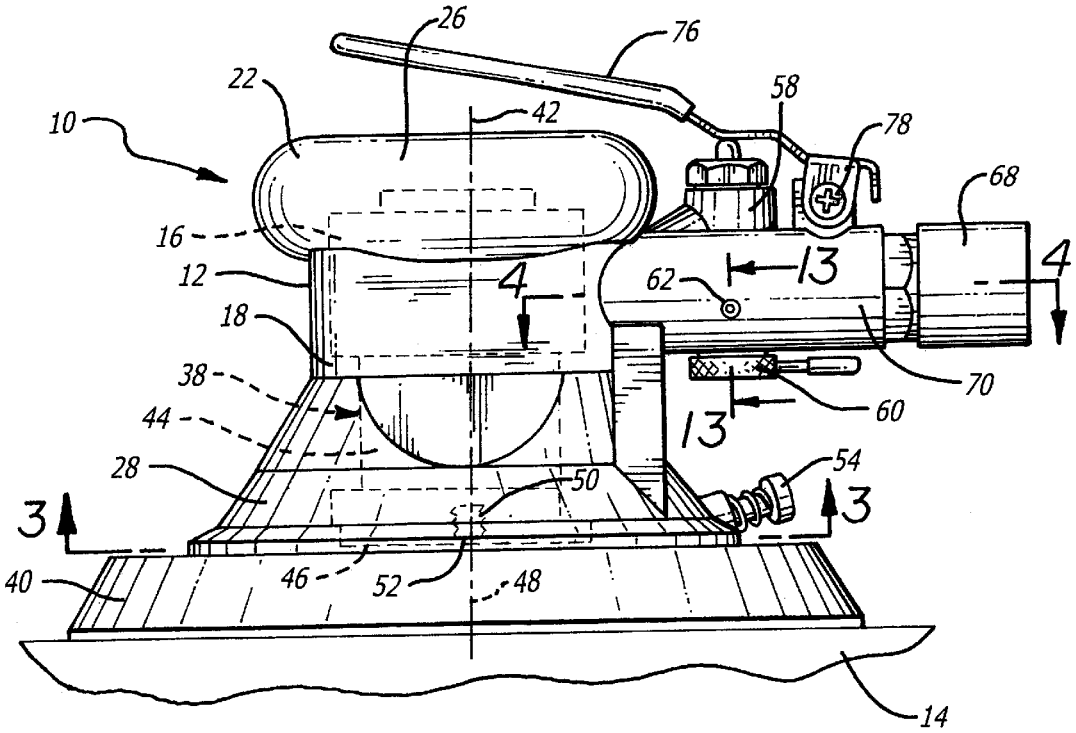
FIG. 1 is a side elevational view of a disclosed embodiment of an orbital sanding tool constructed according to the present invention.
Figure 8:
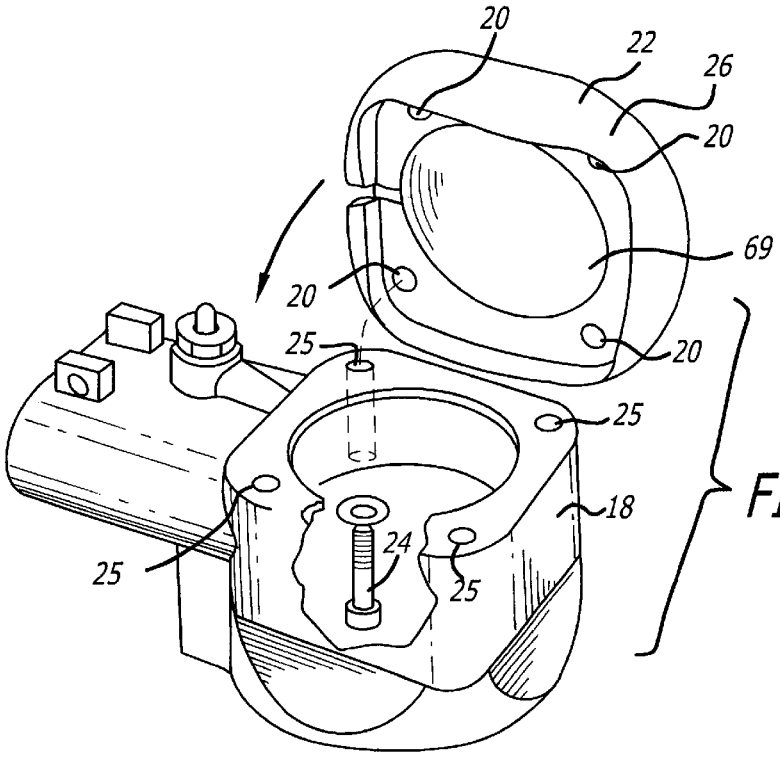
FIG. 8 is an exploded perspective view of the body structure of the sanding tool of FIG. 1, showing how the top cover is secured to the main body section using lugs secured to a reinforcing plate embedded within the top cover.
Figure 9:
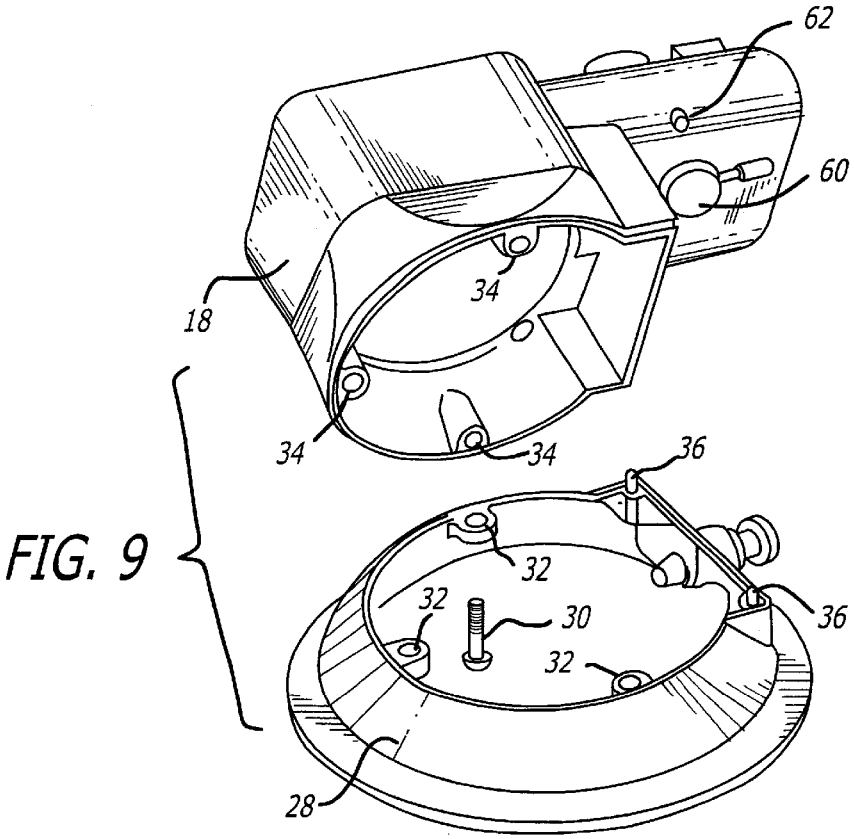
FIG. 9 is an exploded perspective view of the body structure showing how the shroud is secured to the main body section using three screws and two pins.
Figure 10:
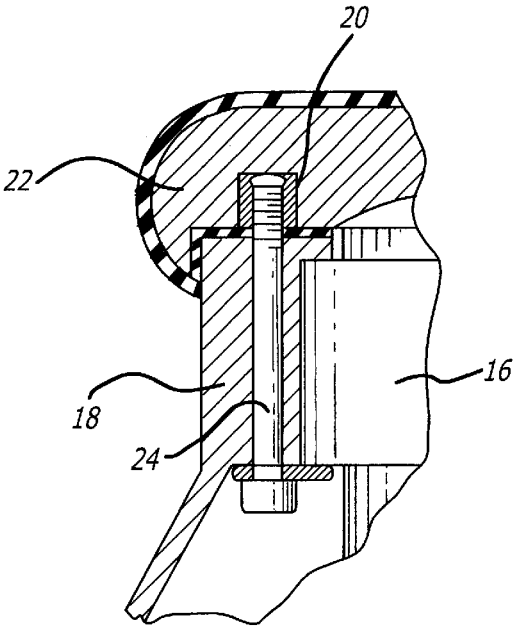
FIG. 10 is a fragmentary vertical cross-sectional view of the orbital sanding tool showing a screw passing through the main body section to secure the top cover utilizing a lug embedded in the top cover.

The tool 10 shown in the drawings is an orbital sander having an injection molded body structure 12 which is shaped externally to facilitate its being grasped by a user to manipulate the sander and move it along a typically horizontal work surface 14 to sand that surface. An air driven motor 16 is contained within a main body section 18 of the body structure 12 (FIG. 1). Four lugs 20 are embedded in a top cover 22 of the body structure 12 (FIGS. 8 and 10). The top cover 22 is secured to the main body section 18 by screws 24 passed upwardly through holes 25 in the top of the main body section 18 and fastened to the lugs 20. The top cover 22 is preferably covered by a cushion 26 of rubber, plastic or other resilient material by which the sander is held. The lower portion of the body structure 12 is made up of a skirt or shroud 28 attached to the main body section 18 (FIG. 9). The shroud 28 is held in place by three screws 30 extending upwardly through holes 32 in the shroud 28 and into tapped bores 34 in the main body section 18. Further anchoring the shroud 28 to the main body section 18 are two pins 36 formed in the top of the shroud 28 and extending into engagement with the main body section 18.

Referring specifically to FIG. 1, the air driven motor 16 acts through an orbital drive structure 38 to move an abrading pad, shoe or head 40 and an attached sheet of abrasive material (not shown) in an orbtial path about a first vertical axis 42 of the motor to sand the surface 14. The orbital drive structure 38 includes a carrier part 44 which rotates about the first axis 42. The orbital drive structure 38 also includes a spindle 46 mounted eccentrically to the carrier part 44 for free rotation about a second vertical axis 48 which is parallel to the axis 42 but offset slightly thereform. This gives the spindle 46 a desired orbital motion about the first axis 42. An externally threaded screw 52 extends from the central axis of the head 40 for engagement with a threaded bore 50 disposed along the second vertical axis within the spindle 46, enabling the head 40 to be detachably fastened to the spindle.

As illustrated in FIG. 3, the spindle 46 can be locked against rotational motion relative to the body of the orbital sander 10 by engaging a spring-loaded plunger 54 with notches 56 along the circumference of the spindle 46. This enables the head 40 to be turned manually relative to the spindle 46 to withdraw the screw 52 from the threaded bore 50, thereby removing the head 40.

Figure 7:
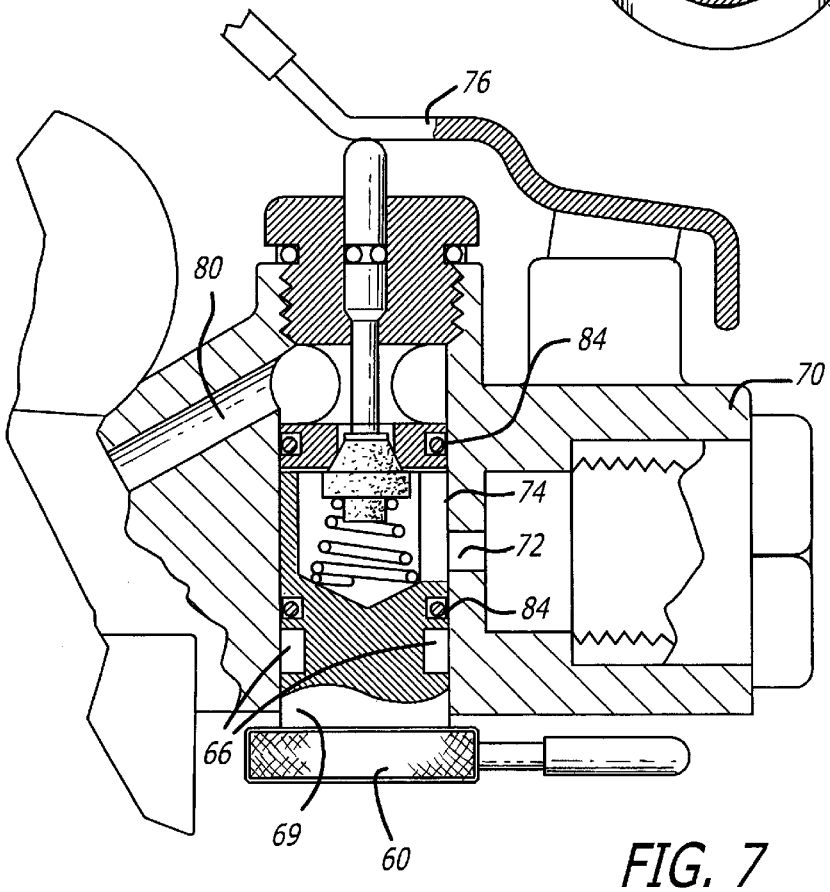
FIG. 7 is a vertical cross-sectional view, partially broken away, taken along the line 7—7 of FIG. 2.
Figure 13:
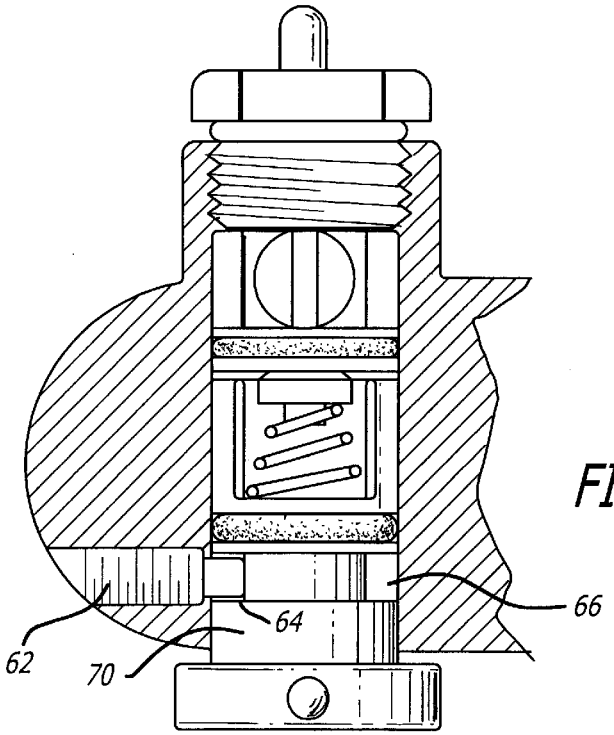
FIG. 13 is a fragmentary vertical cross-sectional view of the orbital tool showing the air control valve structure, including the set screw engaged in a groove formed in the shank of the air control valve, taken along the line 13—13 of FIG. 1.

With reference again to FIG. 1, compressed air is supplied to the motor 16 through a manually actuable valve 58. A separate air control valve 60 is rotatable within the body structure 12 for adjustment of the flow of pressurized air through the tool. In order to prevent the air control valve 60 from being ejected axially from the body structure 12, the air control valve 60 is held in place within the body structure 12 by a set screw 62. The set screw 62 can be a full dog Allen screw wherein the dog end tip 64 engages a groove 66 formed within the air control valve shank 69 (FIGS. 7 and 13).

Figure 4:
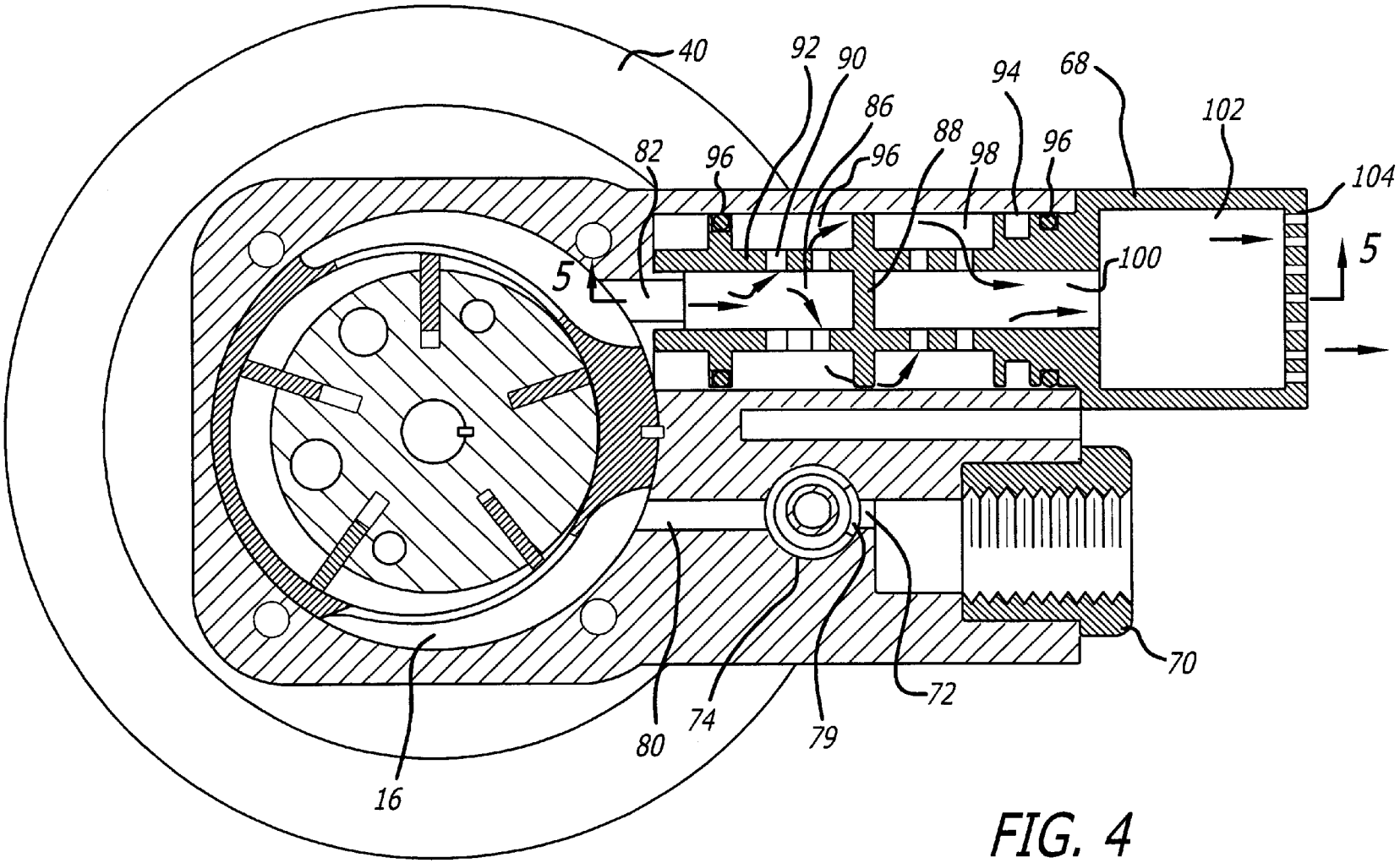
FIG. 4 is a horizontal cross-sectional view of the orbital sanding tool taken along the line 4—4 of FIG. 1.
Figure 5:
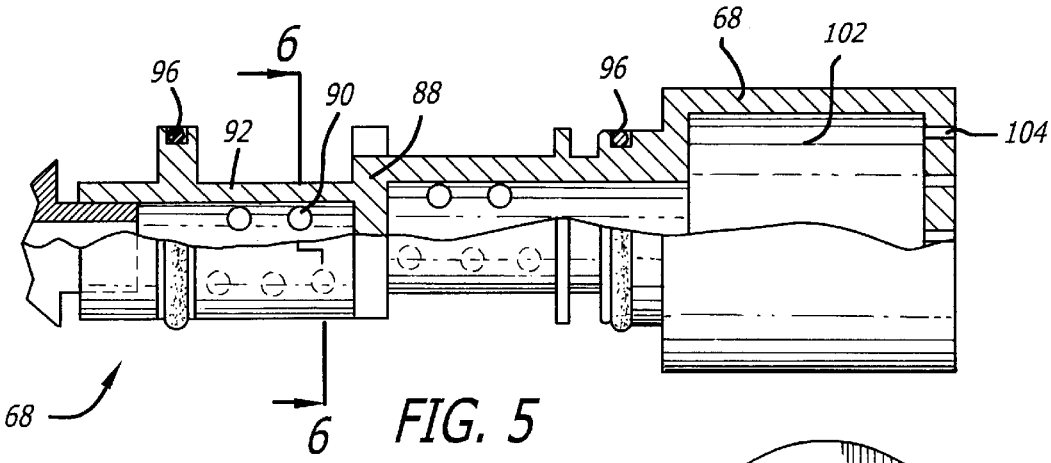
FIG. 5 is a partial vertical cross-sectional view of a muffler of the sanding tool of FIG. 4 taken along the line 5—5.
Figure 6:
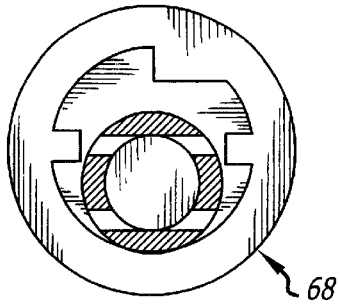
FIG. 6 is a vertical cross-sectional view of the muffler taken along the line 6—6 of FIG. 5.

After driving the motor 16, the compressed air leaves the orbital sander 10 through a silencer, filter, or muffler 68 in order to provide quieter operation. The muffler 68 creates a circuitous path for the exiting air to travel, and thus dampens the acoustic energy of the air (FIGS. 4–6).

Figure 3A:
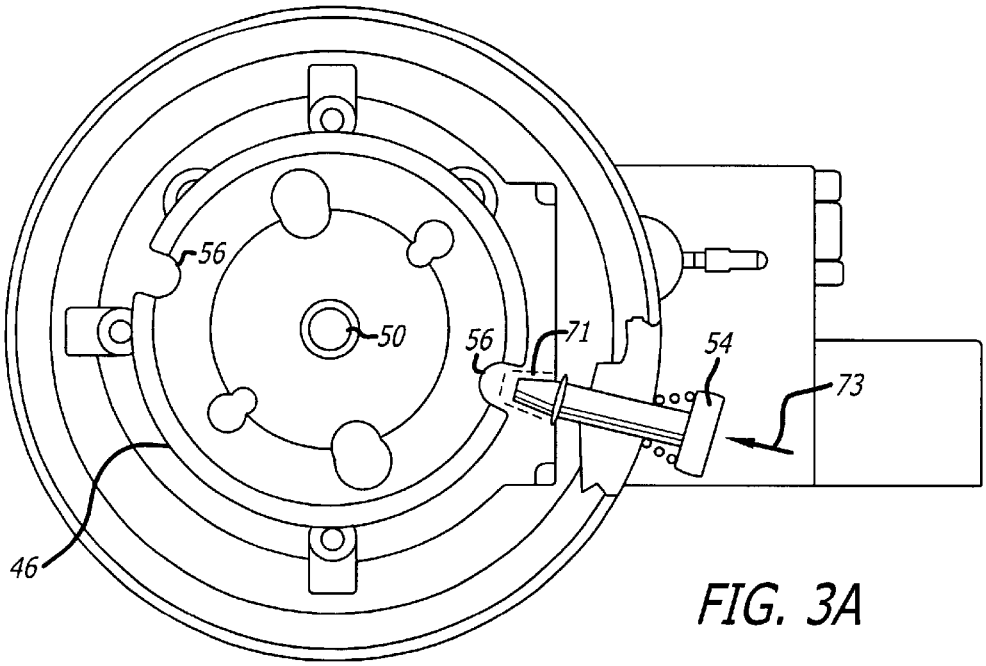
FIG. 3A is a bottom plan view of the orbital sanding tool of FIG. 1 with its head or shoe removed to reveal the spindle and showing the plunger in its normal, retracted condition.
Figure 3B:
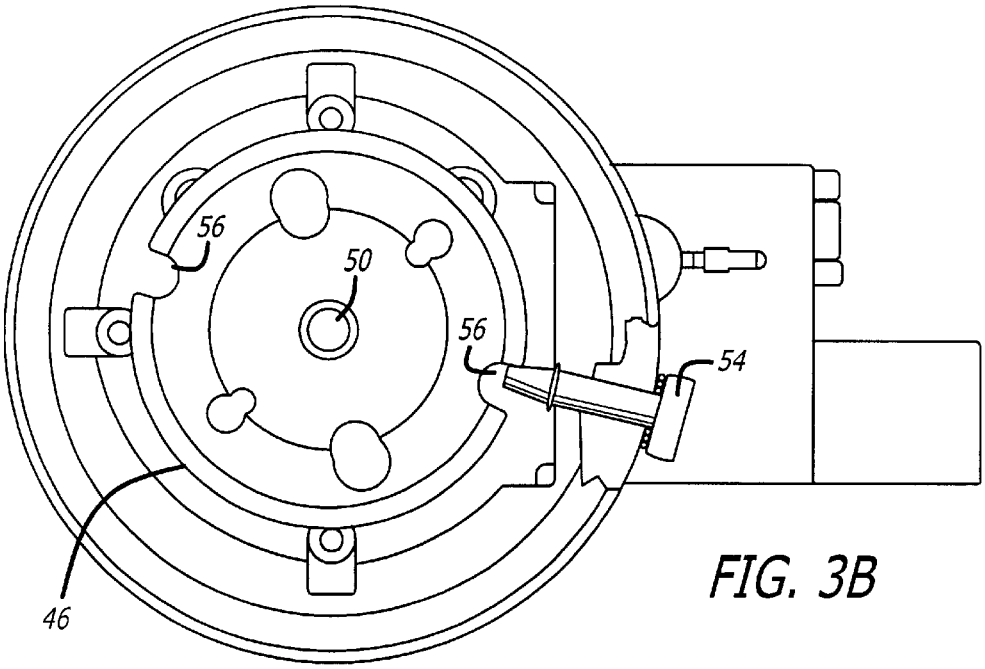
FIG. 3B is a bottom plan view of the orbital sanding tool of FIG. 1 with its head or shoe removed to reveal the spindle and showing the plunger engaging one of the notches even when the spindle is at the furthest point of its travel away from the plunger.

Proceeding now with a more detailed description of certain specific features of the present invention, FIGS. 3A and 3B illustrate the manner in which the spring plunger 54 locks the spindle 46 for replacing the head 40. The tool operator applies pressure to the plunger 54 in order to move it radially inwardly toward the first vertical axis 42 and into engagement with the notches 56 along the circumference of the spindle 46. Because the vertical axis 48 of the spindle 46 orbits about the first vertical axis 42, the outer circumference of the spindle 46 will at some points in its orbital path be relatively close to the plunger 54 and at other points be further from the plunger 54. The plunger 54 is dimensioned and arranged so that when it is in its first, released position it does not contact the spindle 46, even when the spindle 46 is at the location in its orbital path at which it is closest to the plunger 54. At the same time, the plunger 54 is designed to extend approximately 40 mils (0.040 inches) into the notches 56 when the spindle 46 is at the location in its orbital path at which it is furthest from the plunger 54 and when the plunger 54 is fully compressed. FIG. 3A shows the spindle 46 when it is closest to the plunger 54. From the figure, it can be seen that in the first released position, the plunger 54 clears the outer circumference of the spindle 46. Dashed lines 71 show how the plunger 54 engages the notch 56 when compressed in the direction of arrow 73. FIG. 3B shows the spindle 46 when it is furthest from the plunger 54, with the plunger 54 fully compressed to a second position. In this position, the plunger 54 is still able to engage the notch 56.

When it is desired to replace the head 40, the plunger is depressed in the direction of the arrow 73 until the end of the plunger contacts the spindle 46. The head or shoe 40 is then manually turned with the user's other hand until the plunger enters one of the notches 56, thus locking the spindle 46 against further rotation. Now the head 40 can be spun while the spindle 46 remains in place, thereby unscrewing the screw 52 from the threaded bore 50 until the head 40 is separated from the spindle 46. A new head 40 can then be installed by reversing the method.

The spindle locking method described above enables quick and easy replacement of the head 40 without tools. Thus, the orbital sander 10 can be used with different heads to serve, in effect, as a number of different tools. Further, this method permits the shroud 28 to be rigid and yet to be very close to the upper surface of the head. There is no need for a flexible shroud or a large gap because tools need not be introduced beneath the shroud to lock the spindle in place.

Figure 11:
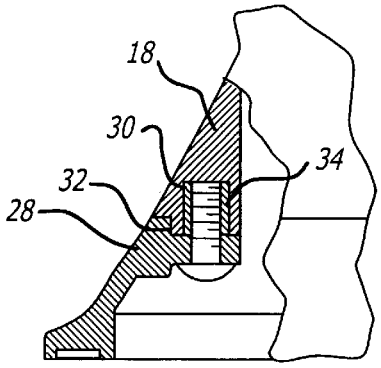
FIG. 11 is a fragmentary partial vertical cross-section view of the orbital sanding tool showing the connection between the body structure to the shroud at the location of one of the attachment screws.
Figure 12:
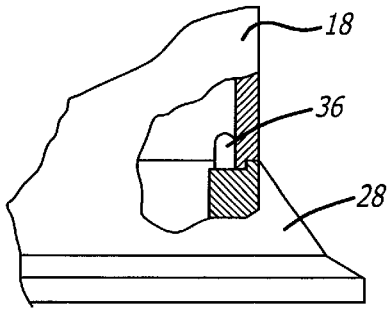
FIG. 12 is a fragmentary partial vertical cross-sectional view of the orbital sanding tool showing the engagement of the pin of the shroud with the inner wall of the main body section.

It is desirable to make the hand-held orbital sander 10 economical as well as light weight for easy handling. In order to achieve these goals, the body structure 12 is injection molded of a suitable synthetic polymeric material. For example, #6 nylon with 38% glass fiber can be used. As illustrated in FIG. 9, the polymeric main body section 18 is attached to the polymeric shroud or skirt 28 to form the body structure 12. The shroud 28 is formed separately from the main body section 18 so that the shroud 18 can be replaced easily for use with heads 40 of different sizes. For example, a 3-inch diameter shroud can be used with a smaller head and a 5 or 6-inch diameter shroud can be used with larger heads. The shroud 28 is secured to the main body section 18 by means of the three screws 30 extending upwardly through the holes 32 in the shroud 28 and into the tapped bores 34 of the main body section 18 (FIG. 11). Further securing the shroud 28 to the main body section 18 are the two pins 36 formed in the top of the shroud 28 and extending into engagement with an internal angular portion of the main body section 18. The two pins 36 can engage the inner wall of the main body section 18 as shown in FIG. 12, or alternatively, holes can be formed in the main body section 18 for receiving the two pins 36. Utilizing the pins 36 reduces the number of screws needed and thus reduces the required tapping and threading of the shroud 28 and the main body section 18. Also, in order to drill and tap into the walls, the walls must be thicker, thus increasing the weight of the sander. Using fewer screws and thinner walls thus reduces the weight of the sander. Further, in order to avoid warping of the thin shroud walls upon cooling of the shroud 28, it is important that the walls have uniform thickness. Utilizing the two pins 36, rather than using extra screws, allows for greater uniformity of wall thickness and thus decreases warpage. Strength is also a consideration when using polymeric materials. Utilizing the pins significantly increases the strength of the joint between the shroud 28 and the main body section 18, thus reducing breakage and increasing reliability. Further increasing the strength of the joint is the lip and groove arrangement formed in the connecting edges of the main body section 18 and the shroud 28 (FIGS. 9, 11 and 12).

As illustrated in FIGS. 8 and 10, four lugs 20 are affixed to the corners of a metal plate 69 embedded within the top cover 22 of the body structure 12. The top cover 22 is secured to the main body section 18 by passing screws 24 upwardly through holes 25 in the top of the main body section 18 and fastening the screws into the lugs 20. Sheet metal nuts or other commercially available hardware can also be used so long as they have inside threads for matching with the threads on the outside of the screws 24. This method saves time and expense by requiring significantly less drilling and tapping than prior art methods in which a top cover is secured to a body structure utilizing screws passing downwardly through the top of the cover and into threaded bores in the body structure. Further, by passing the screws 24 upwardly into the lugs 20, the screws 24 can conveniently be used to support the motor 16 in the main body section 18 as shown in FIG. 10.

Figure 2:
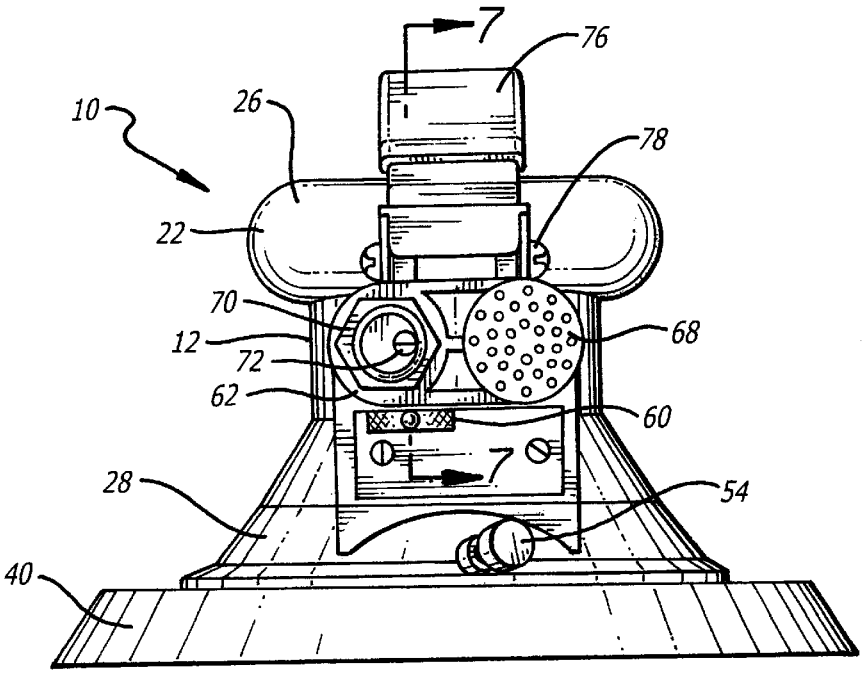
FIG. 2 is a rear elevational view of the orbital sanding tool of FIG. 1.

Referring to FIGS. 1, 2 and 4 together, air is supplied to the motor 16 from a source of compressed air through a line connecting into a rearwardly projecting portion 70 of the body structure 12. From this inlet, air flows through a passage 72 in the portion 70 to a vertical bore 74 containing the manually actuable valve 58. The valve 58 is normally spring urged to its closed position and is adapted to be opened by downward movement of an actuating handle 76 attached pivotally at 78 to the body structure 12 (FIG. 7). The air control valve 60 can be rotated to adjust the degree of alignment between the passage 72 and an entrance hole 79 in the wall of the control valve 60. Greater alignment of the holes provides increased air flow while blockage of the passage 72 can shut off the air flow. Thus, depression of the handle 76 by an operator admits air from the passage 72 to a passage 80 leading to the motor 16, commencing operation of the motor and orbital movement of the head 40. Air discharged from the motor is exhausted to the atmosphere through an outlet passage 82 and the muffler 68 (FIG. 4).

As illustrated in FIG. 7, the air control valve 60 is seated in the vertical bore 74 with O-rings providing an airtight seal to keep pressurized air from escaping. In order to prevent the air pressure from ejecting the air control valve 60 axially from the body structure 12, the valve is held in place within the body structure 12 by the set screw 62. As shown in FIG. 4, after powering the motor 16, exhaust air leaves the orbital sander 10 through the muffler 68 in order to provide quieter operation. The muffler 68 is seated in a bore 94 with O-rings 96 providing an air tight seal to assure that the compressed air passes through the muffler 68. FIGS. 4–6 show how the muffler 68 creates a circuitous path for the exiting air to travel, and thus dampens the acoustic energy contained within the air. Exiting air first passes from the outlet passage 82 into a first internal channel 86 of the muffler 68. The first internal channel 86 is blocked off by a barrier 88, which causes the air to pass through holes 90 in the muffler walls 92, and into a first outer chamber 96 between muffler walls 92 and the-bore 94. Next, the air passes through notches formed in a portion of the barter 88 extending into the outer chamber and passes into a second outer chamber 98 between the muffler walls 92 and the bore 94. The air then passes through holes 90 in the muffler walls 92 and back into a second internal channel 100 of the muffler 68. From there it passes into a widened internal channel 102 and is exhausted to the atmosphere through the holes 104. The circuitous path taken by the air substantially reduces axial and radial fluctuations within the air flow, thereby dampening its acoustic energy.

The present invention is not meant to be limited in use to sanding. Instead, it can be used for any sort of abrading or polishing by using abrading or polishing sheets or pads with the head or shoe 40. The head or shoe 40 itself can also be designed to abrade or polish without any abrading or polishing sheets or pads attached.

While the above description contains many specific features of the invention, these should not be construed as limitations on the scope of the invention, but rather as an example of one preferred embodiment thereof. Many other variations are possible. Accordingly, the scope of the invention should be determined not by the embodiments illustrated, but by the appended claims and their legal equivalents.

What is claimed is:

1. An orbital abrading or polishing tool, comprising:

a tool body to be held and manipulated by a user;

a motor carried by said body;

an orbital drive structure driven rotatably about a first axis by said motor;

a spindle having at least one notch along its outer circumference and which is connected to said orbital drive structure for rotation relative thereto about a second axis offset from said first axis to drive said spindle in an orbital path about said first axis as said orbital drive structure turns;

a head threadedly connected to said spindle and adapted to carry an element for abrading or polishing a work surface; and a plunger passing through said body and movable radially inwardly, said plunger movable between a first position and a second position, wherein in said first position said plunger does not contact the outer circumference of said spindle and in said second position said plunger engages said at least one notch for any position of said spindle along said orbital path.

2. The tool of claim 1, wherein:

said motor is driven by pressurized air.

3. The tool of claim 1, further comprising:

an element carried by said head for abrading or polishing a work surface, wherein said element is sandpaper.

4. A method for replacing a head of an orbital abrading or polishing tool, comprising:

(a) pressing on a plunger to contact a spindle;

(b) manually rotating a first head threadedly connected to said spindle until said plunger enters a notch along the outer circumference of said spindle to lock said spindle against rotation;

(c) manually rotating said first head while said spindle is locked against rotation so that said threaded connection is broken;

(d) positioning a second head relative to said spindle so that said second head can be rotated relative to said spindle to form a threaded connection therebetween;

(e) manually rotating said second head to threadedly and tightly connect said second head with said spindle;

(f) releasing said plunger to disengage said plunger from said notch and thereby allow said second head and said spindle to freely rotate.

* * * * *